United States Patent [19]

Gerry

[11] 4,144,476

[45] Mar. 13, 1979

[54] MULTIPLE DOUBLE ENERGY MODULATION IGNITION SYSTEM

[76] Inventor: Martin E. Gerry, 13452 Winthrope St., Santa Ana, Calif. 92705

[21] Appl. No.: 816,714

[22] Filed: Jul. 18, 1977

[51] Int. Cl.[2] ..... H05B 37/02; H05B 39/04; H05B 41/36

[52] U.S. Cl. ..... 315/209 R; 123/148 E; 315/166; 315/170; 315/176

[58] Field of Search ..... 315/209 R, 209 T, 209 M, 315/213, 172, 214, 176, 215, 216, 170, 171, 209 CD, 166, 167; 307/264; 123/148 E, 148 DC; 361/253, 263

[56] References Cited

U.S. PATENT DOCUMENTS

| | | | |
|---|---|---|---|
| 2,602,149 | 7/1952 | Brunelle, Jr. | 315/213 X |
| 4,033,316 | 7/1977 | Birchenough | 315/176 |

*Primary Examiner*—Saxfield Chatmon, Jr.

[57] ABSTRACT

Energy provided by two circuits each of which has inductive and capacitive components which provide initial conditions for the ignition firing cycle, makes possible high modulated power components of the system for delivery to a high voltage distributor. Such conventional distributor sequences the igniter firing.

8 Claims, 3 Drawing Figures

MULTIPLE DOUBLE ENERGY MODULATION IGNITION SYSTEM

BACKGROUND OF THE INVENTION

This invention is in the field of ignition systems and particularly where such ignition systems intermodulate transient and other generated AC signals.

No prior art exists, particularly in the double energy intermodulated ignition systems.

SUMMARY OF THE INVENTION

A multiple double energy modulation ignition system is provided which comprises a first double energy circuit, and a second double energy circuit, the first and second circuits have means electrically connected therebetween for forming a common intermittent electrical path during operative mode of the system.

The first and second circuits, each comprise an inductor and a capacitor in circuit with the inductor.

Said means may comprise an electrically conductive member driven during said operative mode and having electrically insulative inserts regularly positioned at its periphery within the confines thereof and an electrical contactor in cooperation with said periphery, or said means may comprise an electrically insulative cam driven during said operative mode and a pair of contactors intermittently actuated by said cam during said operative mode. DC power is connected to the first circuit and AC power is induced in the second circuit.

The capacitors of the first and second circuits may have different capacitive values so as to provide an additive initial voltage condition to the forcing AC and DC voltages induced or applied, or may have the same values of capacitances.

The first inductor comprises a typical ignition transformer having a primary and a secondary winding, and energy from the first and second circuits intermodulate, and the intermodulated energy is transferred from the primary to the secondary winding during operative mode of the system.

DETAILED DESCRIPTION

Figure 1:
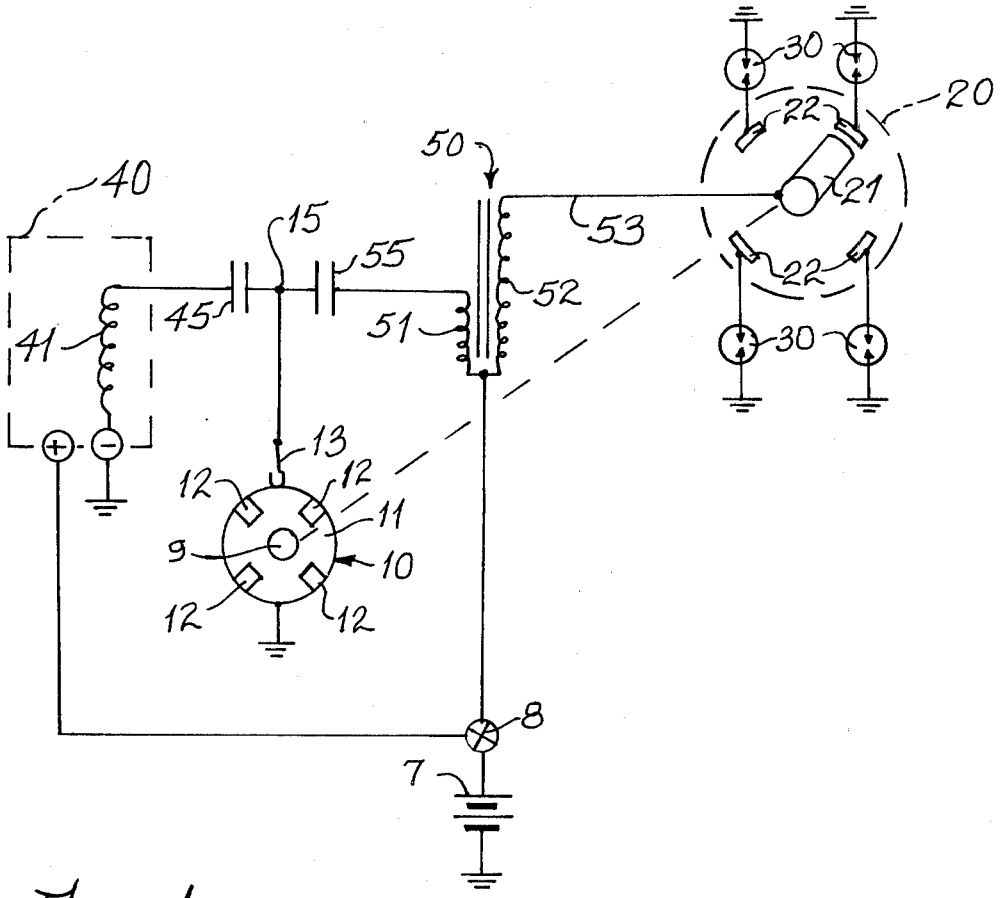
FIG. 1 is an electrical schematic of an ignition system according to the invention.
Figure 2:
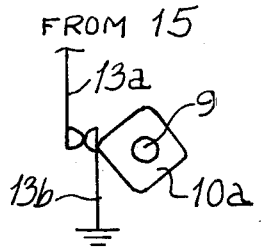
FIG. 2 is a timer that may be used instead of the timer shown in FIG. 1.

Referring to FIGS. 1 and 2, the multiple double energy modulation ignition system is generally powered by a battery 7 through ignition switch 8 to provide DC power to an AC signal source 40 and to ignition transformer 50.

Throughout this description and in the drawings, the conventional ground symbol is used to signify both negative battery potential and electrical signal return path, and no further reference thereto need be made.

A timer is provided at 10, driven by shaft 9 of distributor 20, which shaft is at ground potential. Disk or member 11 of the timer is of electrically conductive material and because same is mounted on shaft 9, the disk is also at ground potential. Wedges 12 of electrically insulative material are regularly spaced at the periphery of disk 11 held within the disk confines, and an electrical contactor 13 in cooperation with the disk periphery is electrically connected to junction point 15. The number of wedges or inserts 12 correspond to the number of cylinders of the engine which the system is used to power. Here, a four cylinder engine is utilized and hence four wedges 12 are shown.

Alternately, a conventional cam 10*a* may be used with point set 13*a*–13*b* instead of timer 10. In such case, point 13*a* would be connected to junction 15 and point 13*b* to ground. Cam 10*a* is likewise driven by shaft 9. There is an advantage in use of timer 10 unit over the point and cam unit, as well as equivalents thereof, in that timer 10 is simple, inexpensive, reliable and has no contact bounce problems.

Conventional distributor 20 is coupled with timer 10 by means of shaft 9 which also drives rotor 21 of the distributor past stationary members 22 to which are connected igniters 30 for sequential firing thereof.

An AC generator, shown at 40, illustrates only the output winding 41 of its output transformer, but is otherwise conventional. Such generator usually is designed to provide rectangular wave output signals, though other waveforms are usable.

One side of winding 41 is at ground potential and the other side is connected to capacitor 45. It is pointed out that capacitor 45 may optionally be inserted between ground and the negative terminal of generator 40, representing the same electrical circuit.

The other side of capacitor 45 is connected to junction point 15 to which is also connected one side of capacitor 55. Capacitor 55 is connected to one side of primary winding 51 of ignition transformer 50. Here too, capacitor 55 could have been connected to the other side of primary widing 51 with the same electrical effect.

The other side of primary winding 51 is joined in autotransformer configuration with one side of secondary winding 52, for this is the normal manner in which conventional ignition transformers are fabricated. The junction of the primary and secondary of transformer 50 is connected to battery 7 through ignition switch 8 as well as the positive potential terminal of AC source 40. The other side of winding 52 is connected by means of wire 53 to rotor 21 to supply ignition energy to distributor 20.

When the circuit shown is at equilibrium, that is after some time has elapsed and junction point 15 is at ground potential due to position of contactor 13 intermediate a pair of wedges 12, then winding 51 and capacitor 55 will have been charged with DC from battery 7 to provide initial conditions in components 51 and 55. Similarly, since the timer acts to provide the common electrical path to ground in this position, AC current will be circulating in winding 41 and capacitor 45 to provide initial conditions therein. AC will not circulate under this charge mode in components 51 and 55 and likewise components 41 and 45 will not be charged with DC due to the common path provided by the timer, isolating each double energy circuit during charge mode only.

However, when timer 10 is driven so that contactor 13 is positioned in full cooperation with one of wedges 12, the ground potential will be removed from junction point 15 and the circuit equilibrium disturbed. Consequently, the circuit will go into its transient or igniter firing mode, which is best described in terms of an equation of voltages around a current loop following Kirchoff's law, and most easily written in Lapace transform mathematics.

Considering the switching transient upon removal of ground from junction point 15, the equation for the voltages added about the current loop, including initial conditions, is:

$$\frac{V}{s} + L_1 i_{10} - \frac{q_{10}}{C_1 s} - \frac{A\omega}{s^2+\omega^2} - L_2 i_{20} + \frac{q_{20}}{C_2 s} = [(L_1 + L_2)s + (R_1 + R_2) + (\frac{1}{C_1} + \frac{1}{C_2})]\, I(s) \quad (1)$$

from which we can solve for I(s), the current in Lapalace transform domain:

$$I(s) = \frac{(L_1 i_{10} - L_2 i_{20})s^3 + (V + \frac{q_{20}}{C_2} - \frac{q_{10}}{C_1})s^2 + (L_1 i_{10}\omega^2 - L_2 i_{20}\omega^2 - A\omega)s + (V\omega^2 + \frac{q_{20}\omega^2}{C_2} - \frac{q_{10}\omega^2}{C_1})}{(s^2+\omega^2)\,[(L_1 + L_2)s^2 + (R_1 + R_2)s + (\frac{1}{C_1} + \frac{1}{C_2})]} \quad (2)$$

After rationalizing by dividing through numerator and denominator by $(L_1+L_2)$, the transform at (2) will be in the form which is shown as transform pair 4–17 at page 212 of Fundamentals of Laplace Transformation of Levy, Mc Graw-Hill Book Company, New York, 1962. Such transform pair yields the solution of (2) in the time domain, having the form:

$$i(t) = k_1 \cos(\omega t - \phi_1) + k_2 e^{-\alpha t} \cos(\beta t - \phi_2) \quad (3)$$

and showing that two frequency components are present in the current wave. One component being a sinusoidal function of $\omega$ radians and a phase angle $\phi_1$, and the other an exponentially decaying sinusoidal function having a frequency of $\beta$ radians and another phase angle $\phi_2$, and corresponding to oscilloscopic observed patterns taken. The voltage induced in primary winding 51 can be obtained by differentiating equation (3) with respect to time and multiplying the result by $-L_1$ value.

Letter designated parameter notations were used here for convenience. The corresponding numerical notations as shown in FIG. 1 is denoted in table (4) below, where applicable, with expalanatory notes defining the terms used:

| Parameter Letter | Numbered Parameters as in FIG. 1 | Type and Value |
|---|---|---|
| $V$ | 7 | battery voltage = 12 volts |
| $L_1$ | 51 | primary winding of transformer 50 |
| $R_1$ | not shown | effective resistance of 51 |
| $C_1$ | 55 | capacitor |
| $\frac{A\omega}{s^2+\omega^2}$ | not shown | corresponds to voltage A sin ωt induced in 41 |
| $L_2$ | 41 | output winding of AC unit |
| $R_2$ | not shown | resistance of 41 |
| $C_2$ | 45 | capacitor |
| $\frac{q_{10}}{C_1}$ | not shown | initial voltage condition provided by 55 |
| $\frac{q_{20}}{C_2}$ | not shown | initial voltage condition provided by 45 |
| $L_1 i_{10}$ | not shown | initial voltage condition provided by 51 |
| $L_2 i_{20}$ | not shown | initial voltage condition provided by 41 |
| $\omega, \beta$ | not shown | frequencies in radians |
| $\phi_1, \phi_2$ | not shown | phase angles |

-continued

| Parameter Letter | Numbered Parameters as in FIG. 1 | Type and Value |
|---|---|---|
| $k_1, k_2, \alpha$ | not shown | coefficients |
| $s$ | not shown | a complex number - the Laplace operator |

(4)

In using two double energy circuits, each having an inductor and capacitor and each being charged with initial charges, the capacitor charged with DC having a charge of opposite potential to the capacitor charged with AC because the AC waveform is positive unidirectional having ground or negative potential as reference and current flowing from the AC source in a direction opposing the flow of the DC current during establishment of the initial conditions, will thus produce very high modulation products of the AC and the transient provided by the DC source, to provide a high induced primary voltage in the ignition transformer and thereby transfer a high secondary voltage to distributor to fire the igniters.

The high intermodulation appears best when capacitors 45 and 55 are of unequal capacitance, and it does not appear from laboratory tests that any one specific capacitor should be larger in capacitance than the other, so long as these capacitors are differently valued, the charge on one will differ from the charge of the other to provide a net resultant initial condition. In the use of the AC circuit 40, the equivalent series capacitance of capacitors 45 and 55 should be of such value so as to nearly maximize energy transfer between source 40 output and transformer 50 input during igniter firing condition. Therefore if as here it turns out that about 0.5 microfarads are required to maximize energy transfer, same can be approximated by use of one capacitor which is about 0.6 microfarads and the other 3.0 microfarads.

It would also appear that either the AC from source 40 can be rectified and supplied as DC to capacitor 45, or that a dual output winding such as another winding like 41 can be used to feed transformer 50 with AC instead of the battery, and intermodulate the two AC charged circuit outputs.

Figure 3:
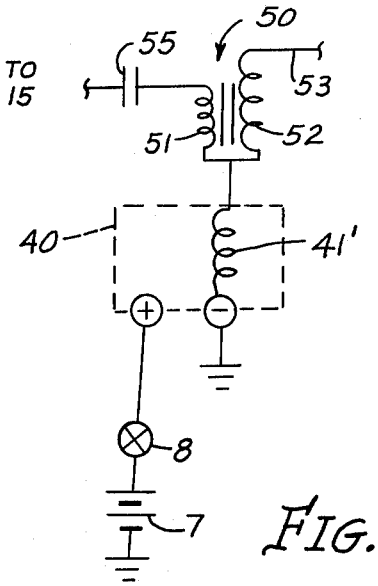
FIG. 3 is a partial electrical schematic of the ignition system showing the use of AC power feeding the primary winding of the ignition transformer used therein.

Consequently, substituting another AC source for battery 7, or having a dual output from source 40 such as another winding like 41' to connect to the junction of primary 51 and secondary 52, instead of battery 7 thereto directly in accordance with FIG. 3 will provide two AC sources to supply the initial conditions as well as the forcing functions during the firing cycle.

Added advantages can be gained if the added AC source is different in magnitude of its output voltage than the source provided at 41, in that the initial conditions in the inductances of one double energy circuit will subtract from the initial conditions of the other double energy circuit for the total circuit inductances involved and for the capacitors as shown, as well as subtracting the forcing functions applied to each double energy circuit if such forcing functions have the same form. If the forcing functions do not have the same form, that is different AC signals are used, then the forcing functions will nevertheless subtract from each other to leave a resultant forcing voltage magnitude applied to the system, even if the modulii of these functions are the same. If the forcing functions have the same modulus and argument, then subtraction of one from the other will result in a zero forcing function applied to the system and only the initial conditions will be effective to create a transient firing current, resulting in a firing current of lower magnitude compared with the magnitude of firing current when the forcing functions do not subtract to zero.

What is claimed is:

1. A multiple double energy modulation ignition system, comprising the combination of:

an ignition transformer having a primary winding and a secondary winding;

a first circuit composed of the primary winding and a first capacitor in series therewith;

a second circuit composed of a second capacitor and an inductor in series therewith, said first and second capacitors having a common electrical junction; and means electrically connected to the common junction for providing intermittent electrical connection between said junction and an electrical return of the system.

2. The invention as stated in claim 1, wherein said means comprises an electrically conductive member driven during said operative mode and having electrically insulative inserts regularly positioned at its periphery within the confines thereof and an electrical contactor in cooperation with said periphery.

3. The invention as stated in claim 1, wherein said means comprises an electrically insulative cam driven during said operative mode and a pair of contactors intermittently actuated by said cam during said operative mode.

4. The invention as stated in claim 1, including a DC power source connected to the first circuit and an AC power source connected to the second circuit.

5. The invention as stated in claim 1, including a first AC power source connected to the first circuit and a second AC power source connected to the second circuit.

6. The invention as stated in claim 5, wherein the magnitudes of voltage outputs from the first and second AC power sources are different.

7. The invention as stated in claim 1, wherein said first and second capacitors have different capacitive values.

8. The invention as stated in claim 1, wherein energy from the first and second circuits intermodulate and said intermodulated energy is transferred from the primary winding to the secondary winding during said operative mode.

* * * * *